United States Patent [19]

Luen

[11] Patent Number: 4,711,310

[45] Date of Patent: Dec. 8, 1987

[54] ROTARY HEAD

[76] Inventor: Lam M. Luen, 5000 Marine Parade Road, Laguna Park, Blk.G 04-27, Singapore-1544, Singapore

[21] Appl. No.: 794,017

[22] Filed: Nov. 1, 1985

[30] Foreign Application Priority Data

Jan. 4, 1985 [GB] United Kingdom ..... 8500190
Jul. 15, 1985 [GB] United Kingdom ..... 8517815

[51] Int. Cl.[4] ..... E21B 3/02; E21B 21/12

[52] U.S. Cl. ..... 175/171; 175/173; 175/215

[58] Field of Search ..... 175/113, 171, 173, 211–215, 175/170, 257, 320, 324, 207; 285/133.1, 133.2, 12, 138, 177, 122, 123, 272, 333

[56] References Cited

U.S. PATENT DOCUMENTS

| | | | |
|---|---|---|---|
| 2,327,499 | 8/1943 | Burch | 175/211 |
| 2,548,463 | 4/1951 | Blood | 175/212 |
| 3,054,465 | 9/1962 | Fish | 175/207 |
| 3,157,236 | 11/1964 | Arthur | 175/170 |
| 3,259,403 | 7/1966 | Hjalsten et al. | 175/215 |
| 3,297,100 | 1/1967 | Crews | 285/133.1 |
| 3,385,382 | 5/1968 | Canalizo et al. | 175/212 |
| 3,572,449 | 3/1971 | Brocas et al. | 175/173 |
| 3,734,212 | 5/1973 | Perlewitz | 175/171 |
| 3,807,514 | 4/1974 | Murrell | 175/215 |
| 4,103,745 | 8/1978 | Varich et al. | 173/57 |

FOREIGN PATENT DOCUMENTS

| | | | |
|---|---|---|---|
| 1065308 | 5/1954 | France | 285/133.1 |
| 1129867 | 1/1967 | United Kingdom . | |
| 1393388 | 8/1972 | United Kingdom . | |

*Primary Examiner*—Stephen J. Novosad
*Assistant Examiner*—Hoang C. Dang
*Attorney, Agent, or Firm*—Armstrong, Nikaido, Marmelstein & Kubovcik

[57] ABSTRACT

A rotary head for a drilling machine, the rotary head comprising: lower, intermediate and upper device (1,3 and 61 or 62) for engaging a plurality of drilling tools; a mechanism (8,5) for rotating drilling tools engaged by the engaging devices at a speed which is adjustable; and flushing structure comprising a plurality of flushing apertures (25,44,11 or 52) for supplying flushing fluid to or from drilling tools engaged by the engaging devices.

15 Claims, 16 Drawing Figures

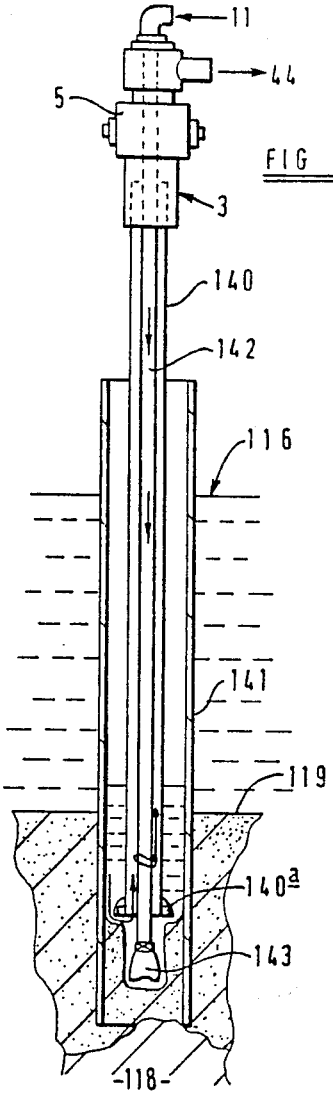
FIG 12
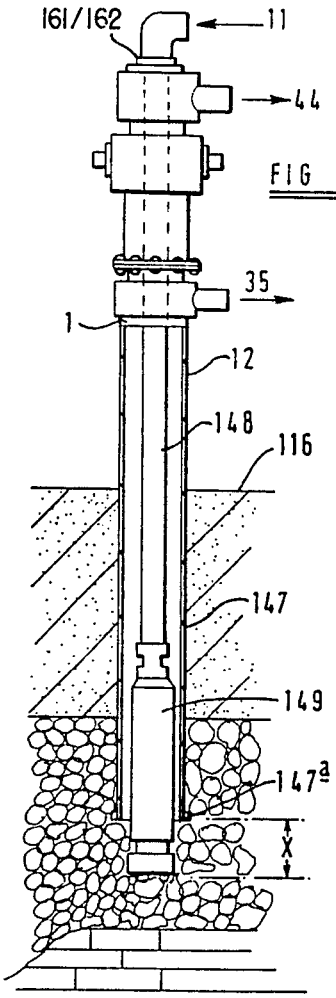
FIG 14
FIG 13
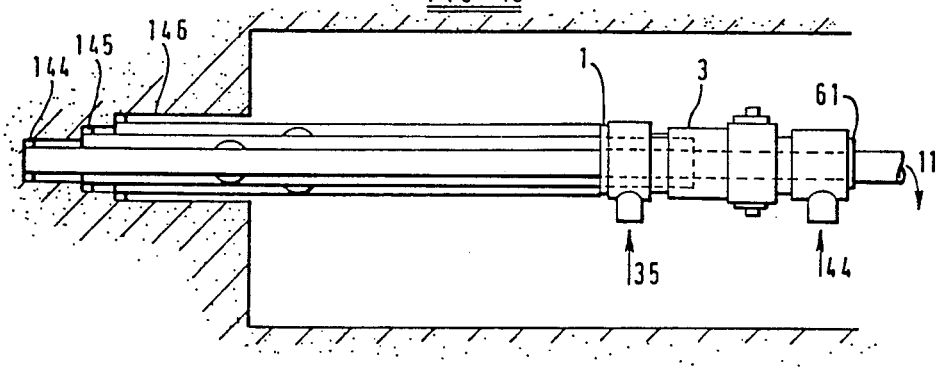

ROTARY HEAD

BACKGROUND OF THE INVENTION

This invention relates to a rotary head for a drilling machine, for example a drilling machine for use in harbor construction, the construction of foundations for bridges or highways or railways, tunnel drilling and the like.

Most previously proposed rotary heads used in the reverse-circulating drilling method have a flushing outlet at the upper end thereof and a connection device, for example a screw-threaded end, for connection to a drilling tool at the lower end. Therefore it is necessary to attach a one inch (2.4 cm) air pipe fitting outside the drill pipe or tools. In addition, it is necessary to make sure that every drill rod is in line with the air pipe. Therefore a considerable amount of time is required to assemble and disassemble parts such as the drill string and tools for use. Thus, such a rotary head has a very low efficiency or productivity.

Recently, over-drilling methods have been proposed in which a drill rod and a drill casing can be rotated simultaneously to drill into the ground to be bored. Although, such an arrangement has increased efficiency, the drill rod cannot be seen from the outside and therefore, when the drill casing is unscrewed, the drill rod may easily become unscrewed without being noticed and may therefore drop into the bore.

Furthermore, previously proposed rotary heads normally have a rotation speed below 50 revolution per minute (rpm), the highest speed being approximately 100 rpm, and the efficiency of drilling bits such as roller bits or diamond bits cannot be maximized at such low speeds so that such rotary heads have a poor uneconomic performance.

OBJECT AND SUMMARY OF THE INVENTION

It is an object of the present invention to overcome or at least mitigate the above mentioned problems.

According to one aspect of the present invention there is provided a rotary head for a drilling machine. The rotary head comprises a means for engaging a plurality of drilling means, a means for rotating drilling engaged by the engaging means at a speed which is adjustable, and a flushing means comprising a plurality of flushing apertures for supplying flushing fluid to or from drilling tools engaged by the engaging means.

In a second aspect, the present invention also provides a rotary head for a drilling machine. The rotary head comprises upper, intermediate and lower engaging means spaced apart on the rotary head where each engaging means engages one or more drilling tools, a flushing means comprising three flushing apertures for supplying flushing fluid to or from drilling tools engaged by the engaging means, and means for rotating the drilling tools engaged by the engaging means at a speed which is adjustable.

The present invention also provides a multi-connection, multi-flushing aperture and multi-speed rotary head comprising a gear box, a hydraulic pipe unit, a lower flushing aperture, a lower connection device for engaging a drilling tool, an intermediate flushing aperture, an intermediate connection device for engaging a drilling tool, an upper flushing aperture and an upper connection device for engaging a further drilling tool.

BRIEF DESCRIPTION OF THE DRAWINGS

For a better understanding of the present invention, and to show how the same may be put into effect, reference will now be made, by way of example, to the accompanying drawings, in which:

FIG. 12 llustrates a further method of circulation drilling using a rotary head in accordance with the present invention;

FIG. 13 illustrates a method of horizontal reverse circulation drilling using a rotary head in accordance with the present invention;

FIG. 14 illustrates a method of drilling stony or rocky ground using a rotary head in accordance with the present invention;

FIG. 15 illustrates a method of over-burden drilling using a rotary head in accordance with the present invention;

FIG. 16 illustrates a further method of over-burden drilling using a rotary head in accordance with the present invention;

FIG. 17 illustrates a method of grouting during ground anchoring using a rotary head in accordance with the present invention;

FIG. 18 is a schematic plan view of a three-stage connection device or adapter of the rotary head shown in FIG. 1; and FIG. 19 is an enlarged view of part of a thread of the adapter as shown in FIG. 18.

DETAILED DESCRIPTION OF PREFERRED EMBODIMENTS

Figure 1:
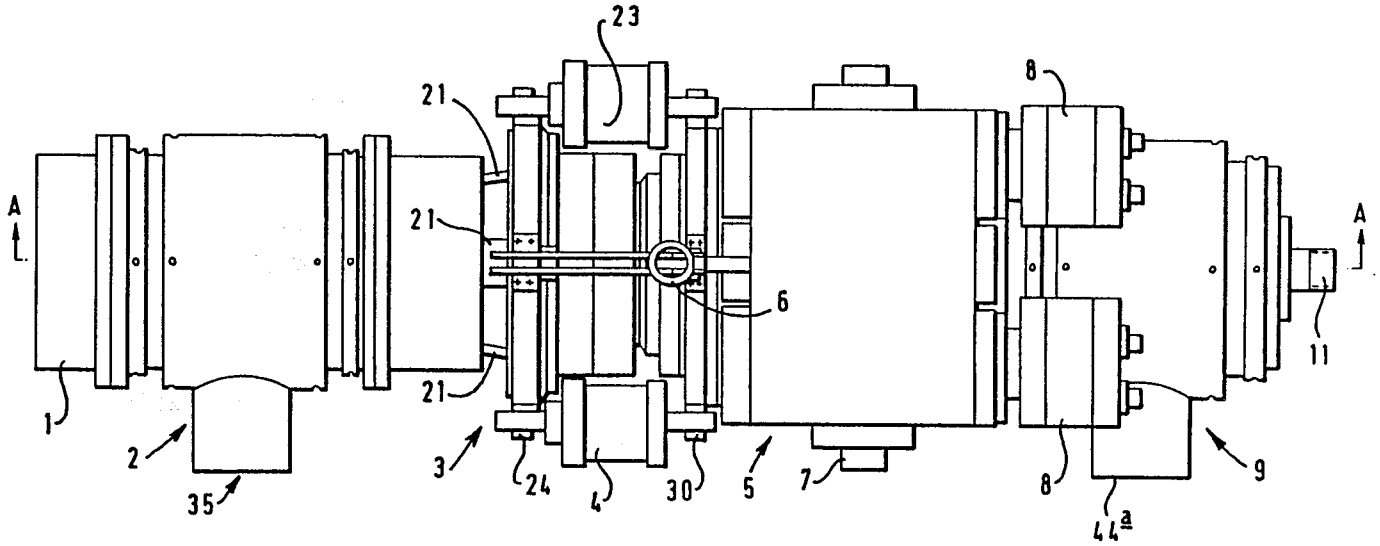
FIG. 1 is a top plan view of a rotary head in accordance with the invention.
Figure 2:
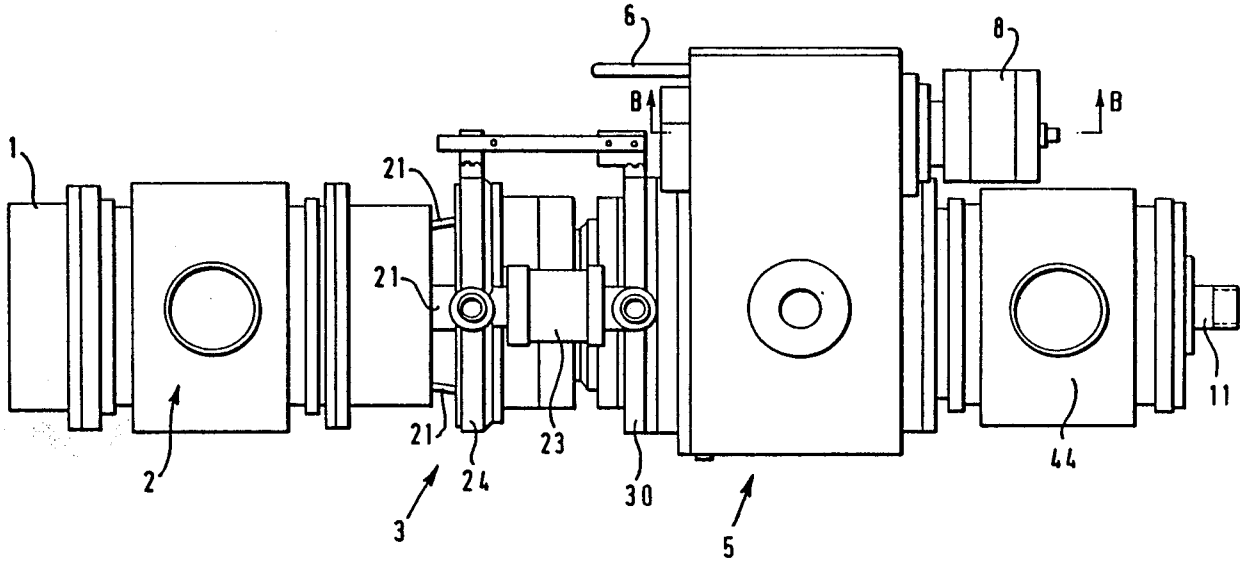
FIG. 2 is a side view of the rotary head of FIG. 1.
Figure 3:
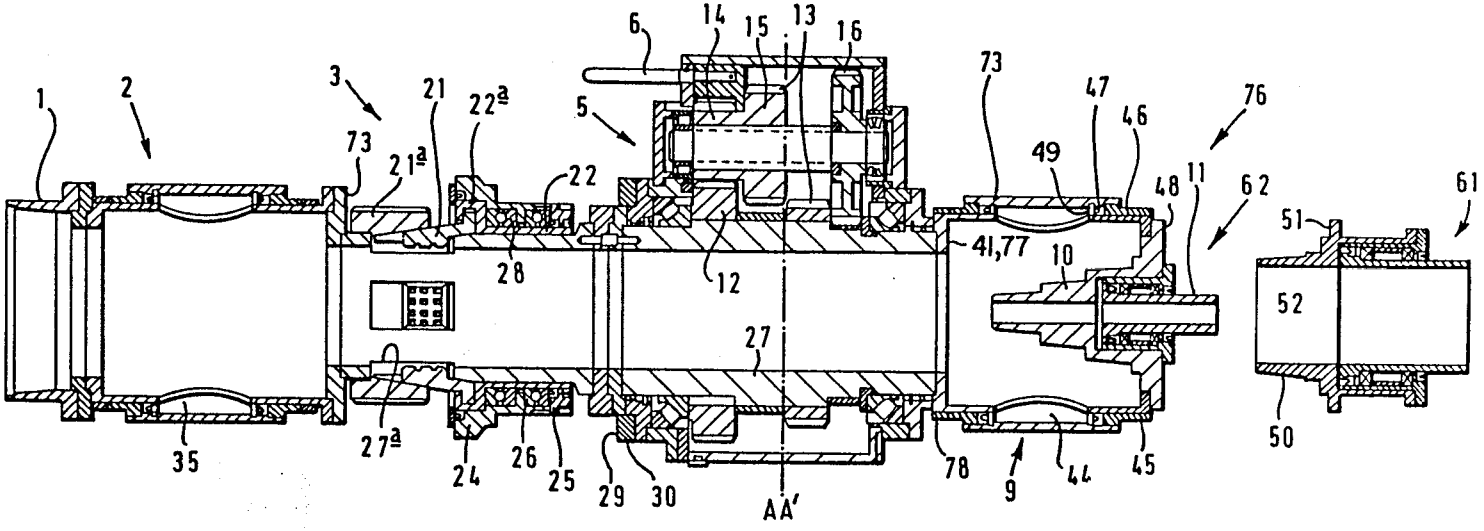
FIG. 3 is a cross-sectional view taken along with line A—A of FIG. 1.

Referring now to the drawings, FIGS. 1, 2 and 3 show a rotary head in accordance with the invention for use in a drilling machine to rotate drilling tools such as drilling rod, drilling casings etc.

As shown, the rotary head has a first or lower internally screw-threaded end portion or connection device 1 for engaging a drilling means, for example a drilling rod casing to form a joint therewith. A first or lower flushing unit 2 having a flushing aperture 35 is provided adjacent the connection device. A second connection device for engaging a drilling tool comprises a flange adapter which is received in a top end of the rotary head. As shown in FIG. 3, different type of adapters can be used, for example either a three-stage adapter 62 or a single stage adapter 61 as will be described in detail hereinafter. Each of the adapters has a central top flushing channel for supplying flushing fluid to or from a drilling tool. A further connection device in the form of a hydraulic clamp unit 3 is provided intermediate the first and second connection devices and a further or upper flushing aperture 44 is also provided intermediate the lower and top apertures. A main shaft 27 of the rotary head has a gear box 5 mounted thereto. The gear box 5 is a two-speed gear box having a speed-control lever 6 which allows the speed of rotation of the rotary head to be controlled by changing the transmission gear ratio as will be described in detail hereinafter.

The first or lower connection device 1 has an internally screw-threaded cylindrical end section for engaging an externally screw-threaded end section of a drilling tool. In the preferred arrangement, the screw-thread has two turns per inch (TPI) (0.8 turns per cm) and a four degree taper so that the first connection device can be used to engage either a ten inch (25.4 cm) or twelve inch (30 cm) drill casing. The screw-thread may be either left or right handed as required. The lower flushing aperture 35 (FIG. 3) is preferably of 6 inches (15 cm) internal diameter and can function either as a flushing fluid inlet or a flushing fluid outlet during drilling.

The hydraulic clamp unit 3 comprising the further connection device is located between the gear box 5 and the first connection device and comprises two hydraulic piston and cylinder arrangements or jacks 23 and a clamp system. The structure of each jack 23 can be seen most clearly in FIGS. *7a* to *7c*. The piston 23*a* and cylinder 23*b* of each hydraulic jack 23 are connected by spherical bearings to respective supporting plates 24 and 30 (FIG. 3). The supporting plate or member 24 surrounds a main shaft 27 of the rotary head and is keyed thereto so as to be slidable therealong within a distance of 35 mm but so that the supporting plate 24 cannot rotate relative to the shaft 27. The upper supporting plate 30 is connected to the bottom of the gear box 5 by sixteen screws of M12×1.5.

As shown in FIG. 3, four jaws 21 are mounted inside the supporting member 24 so that the lower part of each jaw 21 extends into a respective elongate slot 27*a* extending axially of the main shaft 27 so that the jaw can slide along the slot. An upper part of each jaw has an enlarged head portion which is received within an annular groove defined by a deformed end portion 22*a* of a bearing sleeve 22 provided between the main shaft 27 and the supporting member 24. Thrust ball bearings 28 and plain bearings 26 are provided between the bearing sleeves 22 and the supporting member 24. An adjusting nut 25 is provided to lock the plain bearings 26 so that the bearing sleeves 22 and supporting member 24 are slidable along the main shaft 27 as a single unit while the bearing sleeve 22 can still rotate relative to the supporting member 24. Blocks or limit means are mounted within the annular groove of the bearing sleeve 22 to limit movement of the jaws 21 relative to the groove so that, when the jaws 21 rotate with the main shaft 27, the bearing sleeve 22 will also rotate.

The hydraulic jacks 23 are provided to slide the supporting member or plate 24 along the main shaft 27 as described above. The cylinder of each hydraulic jack 23 is four inches (10 cm) in internal diameter and so has a cross-sectional area of 12.56 square inches (81/03 $cm^2$) to provide a push force of 25 tons when the hydraulic pressure applied thereto is 2,200 pounds per square inch (PSI) ($1.52\times10^7 Nm^{-2}$) so that the resultant force applied to the supporting member 24 by the two cylinders is 25 tons. Each of the jaws 21 has an 8° external taper and is provided with hardened teeth to clamp the outside diameter of a drilling tool such as a drill casing or pipe received within the rotary head. A push force of approximately 6 tons is applied to each jaw 21 when a force of 25 tons is applied to the four jaws by the bearing sleeve 22 when the hydraulic jacks 23 are actuated. As shown in FIG. 3, the 8° tapers outer surfaces of the drawers engage correspondingly taped inner surfaces of a sleeve 21*a* which causes the jaws to move together as they are pushed downwardly toward the first connection device so that a pipe placed within the main shaft 27 is gripped by the jaws 21 and thereby clamped tightly. The force supplied to the surface of a pipe or casing gripped by the jaws 21 will be 220 pounds per square inch ($1.52\times10^6 Nm^{-2}$) as the four jaws 21 each have a teeth area of 9 square inches (58 $cm^2$) and a force of 0.9 tons is applied thereto. As the compressive strength of stainless steel pipe is not less than 2000 PSI ($1.37\times10^7 Nm^{-2}$) the pipe will not be damaged by the jaws 21. Moreover, the hydraulic clamp unit 3 allows the pipe to rotate either in the clockwise or the anti-clockwise direction with the rotary head during drilling.

Figure 4:
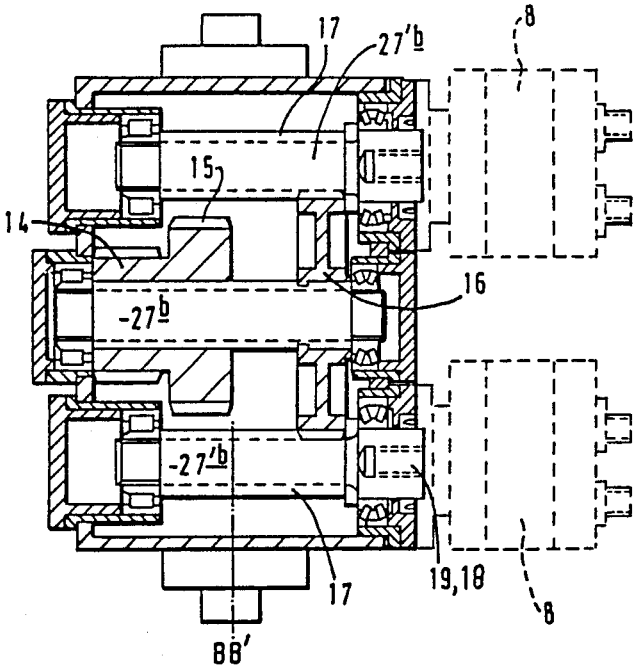
FIG. 4 is a cross-sectional view taken along with the line B—B of FIG. 2.
Figure 5:
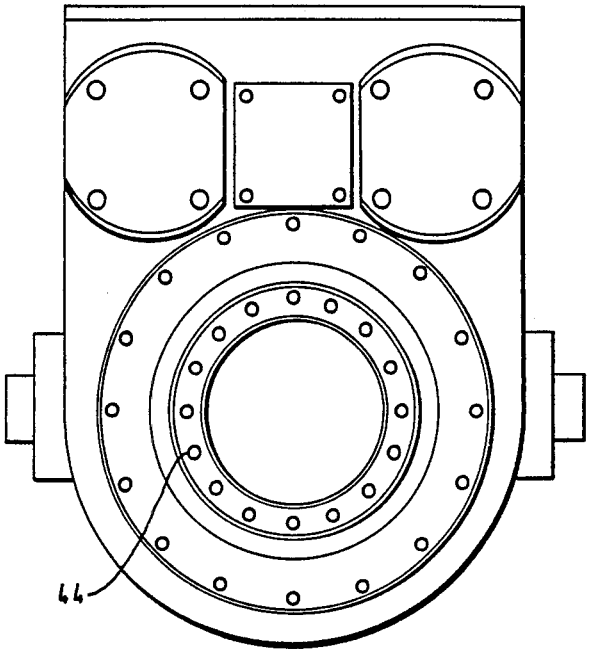
FIG. 5 is a rear view of the rotary head shown in FIG. 1.
Figure 6:
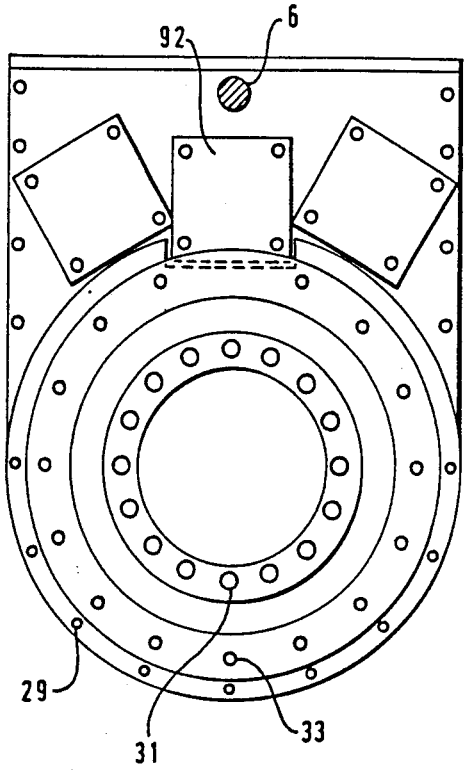
FIG. 6 is a front view of the rotary head shown in FIG. 1.
Figure 7C:
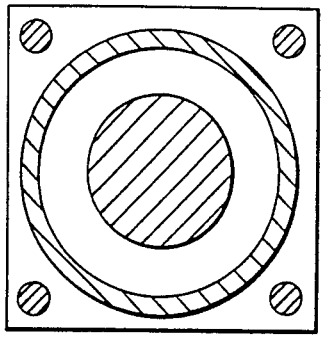
FIGS. 7A, 7B and 7C show the structure of a hydraulic jack of the rotary head of FIG. 1.
Figure 7A:
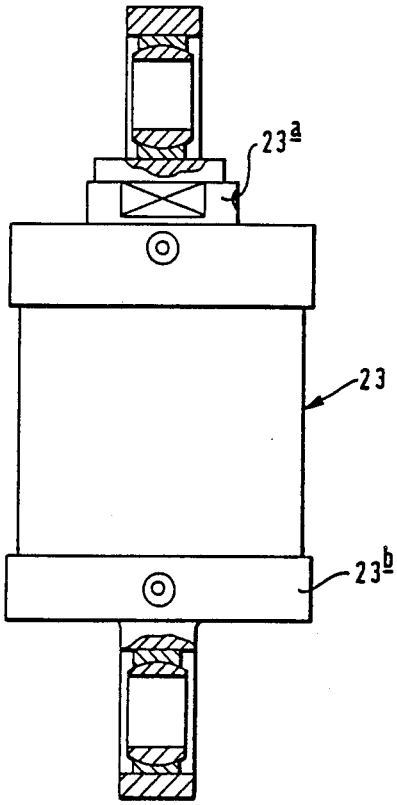
Figure 7B:
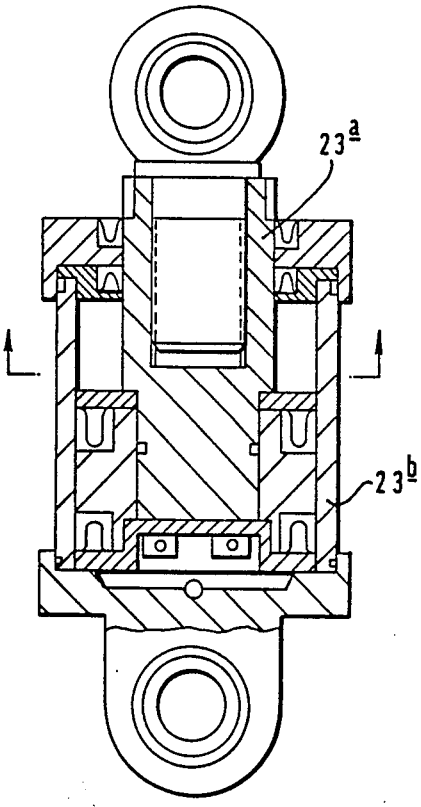

Referring now to FIGS. 3 and 4, the gear box 5 is, as mentioned above, mounted to the main shaft 27.

As shown in FIGS. 3 and 4 the gear box 5 has three subsidiary shafts 27*b* arranged above and in parallel to the main shaft 27. The outermost subsidiary shafts 27′*b* are connected directly to the drive shafts of respective hydraulic motors 8 while the middle or intermediate shaft 27*b* transmits power from the hydraulic motors 8 to the main shaft 27 via the gear arrangement which will now be described.

Two large gears 12 (Z1) and 13 (Z2) are mounted on the main shaft 27 which has an internal diameter of 200 mm. The large gear 12 has 52 teeth and has a pitch diameter of 416 mm while the other large gear 13 has 45 teeth and has a pitch diameter of 360 m. Thus each of the large gears 12 and 13 is of module 8. Three gears 14(Z3) 15 (Z4) and 16(Z5) are mounted on the intermediate subsidiary shaft 27*b*. The speed control lever or handle 6 is provided so as to move the gears 14 and 15 axially along the intermediate subsidiary shaft 27*b* so that either the gear 14 engages with the large gear 12 or the gear 15 engages with the large gear 13 to transmit power to the main shaft 27. The gear 14 has 13 teeth and a pitch diameter of 104 mm while the gear 15 has 20 teeth and a pitch diameter of 160 mm thus giving each of the gear 14 and 15 a module of 8.

The outermost subsidiary shafts 27′*b* are gear shafts 17(Z6) which have 12 teeth and a pitch diameter of 60 mm. The gear shafts 17 engage a further gear 16 carried by the intermediate subsidiary shaft 27*b*, the gear 16 having 48 teeth and a pitch diameter of 240 mm so that it is of module 5. A respective ring gear 18 having 10 teeth and a pitch diameter of 30 mm is mounted to each of the outermost shafts 27′*b* and engages a respective identical gear 19 mounted on the shaft of the corresponding hydraulic motor 8 to transfer power from the motor 8 to the associates gear shaft 27*b*.

When the hydraulic motors are capable of from 0 to 1800 RPM the RPM of the main shaft 27 is:

$$\text{First Speed } (0 - 1800) \times \frac{60}{240} \times \frac{104}{416} = (0 - 112.5)\text{RPM.}$$

When the gear 14 engages the large gear 12; and $$\text{Second speed } (0 - 1800) \times \frac{60}{240} \times \frac{160}{360} = (0 - 200)\text{RPM.}$$

when the gear 15 engages the large gear 13. if the hydraulic motors 8 are connected in series then the speed of the main shaft 27 will be doubled to a maximum of 400 RPM.

An upper connection element 76 comprising an upper or intermediate flushing unit 9 in which the second connection device or adapter is received is secured to an upper end of the main shaft by means of respective screws passing through sixteen screw holes 77 provided in the connection element 76 aligned with corresponding screw holes 41 provided in the end of the main shaft 27 so that the connection element 76 rotates with the main shaft 27. The connection element 76 has two collars 45 one adjacent the main shaft and one adjacent the other end of the connection element, both of the collars 45 46 being tightened around the connection element by means of screws 78. The upper or intermediate flushing unit has an aperture 44 which is provided between the two collars 45 46. Bronze flanges 46 are provided on either side of the flushing aperture 44 to support a flushing pipe (see FIG. 1). U-shaped oil seal rings 47 are provided within the internal diameter of the bronze flanges 46 and are locked in position by means of circlips 49. The internal diameter of the flushing aperture 44 should be large enough to enable the aperture to function either as a flushing inlet or a flushing outlet.

The second connection device or adapter 61 or 62 can be connected, as shown in FIGS. 1 to 3 to the upper end of the connection element 76 be means of sixteen screw connections 48. FIG. 3 shows a first adapter 62 connected to the connection element 76 and also shows a second alternative adapter 61 separate from the rotary head.

As shown most clearly in FIG. 3, the adapter 61 has a single externally screw-threaded adapter section 50 which has a four degree external taper and two threads per inch (0.79 threads per cm), the screw-thread being either left or right handed. The single screw-threaded adapter section 50 is designed to engage a drill casing of large diameter, for a drill casing of five inches, six inches or seven inches (12.7 cm, 15.24 cm or 17.8 cm) diameter. However as only one diameter of casing may be connected to the single adapter section adapter 61, it will be necessary to provide different sizes of adapter 61 to fit different diameter casings, for example three different adapters 61 for three different diameter casings, if is intended that a single section adapter such as the adapter 61 only be provided. However, the adapter 61 has the advantage of enabling a large central bore 52 to be formed therein to provide a further flushing fluid inlet or outlet. The reference numeral 51 indicates holes for connecting the adapter 61 to the end of the connection element 76.

The other adapter 62 is a three-stage flange adapter which has the advantage of allowing three different diameters of casing or rods to be connected thereto but the disadvantage of providing only a small diameter central flushing bore 11. Thus, typically, the diameter of the flushing bore 11 is only 1½ inches (3.8 cm) and the flushing bore 11 can therefore only be used as an inlet for flushing fluid. When the three-stage flange adapter 62 is used, the upper or intermediate flushing pipe **44*a* should be removed to enable an operator to ensure that drill rods or cases connected to the adapter 62** are not unscrewed inadvertently.

The flange adapter 62 is shown more clearly in FIG. 18. Thus, the flange adapter has three externally screw-threaded adapter sections **10*a*, 10*b*, and 10*c*, which decrease in diameter stepwise from the largest adapter section 10*a* to the smallest adapter section 10*c*. Preferably, the screw-thread of the top or largest adapter section 10*a* extends in the opposite direction to the screw-threads of the smaller adapter sections 10*c* and 10*b* and conveniently the adapter section 10*a* has a left-handed screw-threaded and the other two have a right handed screw-thread. This arrangement is designed to prevent a drill rod carried by the largest adapter section 10*a*** being accidentally unscrewed when a drill casing carried by one of the other two adapter sections is unscrewed.

FIG. 19 illustrates schematically and on an enlarged scale the profile of the screw-thread of the adapter sections shown in FIG. 18. As shown in FIG. 19, the thread is 45° or 90° thread having a pitch diameter of 12 mm and a depth of 3 mm. Such a type of thread can withstand the impact forces and torsion forces which may be applied thereto by a drill rod or other drilling tool during drilling and, moreover, is the same as that of various kinds of drill rods or drill tools to ensure correct connection thereto.

As will be appreciated, the rotary head described above may be used in many drilling methods. However, various examples of the use of the rotary head will now be described with reference to FIGS. 8 to 17.

Figure 8:
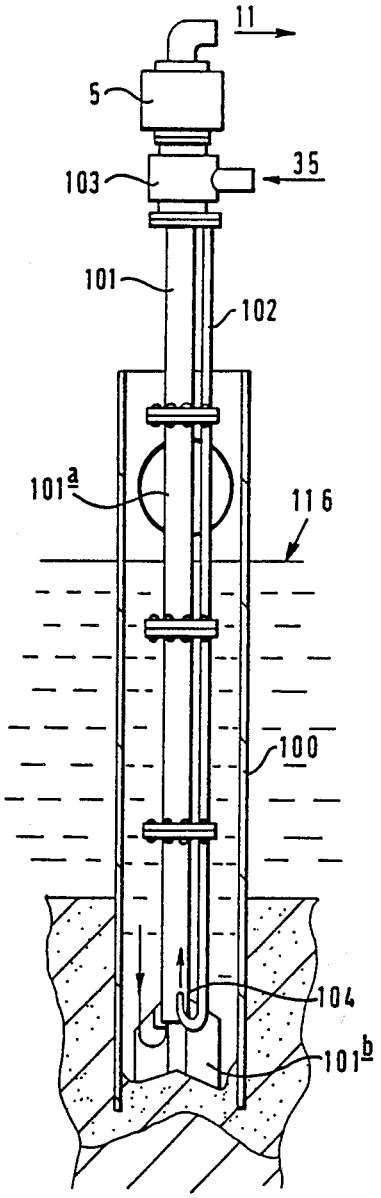
FIG 8 PRIOR ART
FIG. 8 illustrates a previously proposed reverse-circulation drilling method.

FIG. 8 illustrates a present method of reverse-circulation drilling in a sea or river bed, the surface of the sea or river being indicted by the reference numeral 116. In the present method, when a pile tube 100 has been inserted at the position at which it is intended to form the bore, a specially made reverse-circulation drilling tool 101 of 6 inch or 7 inch (15 cm or 18 cm) in diameter has to be assembled from specially made flanged sections **101*a* and inserted into the pile tube 100 making sure that a 1 inch to 0.75 inch (2.5 cm to 1.9 cm) air pipe 102 running along the drilling tool 101 is in line, is not constricted and is secured in place. Next, the bottom of the reverse circular drilling tool is connected to a specially made drilling bit 101*b* and an air jet nozzle 104 at the end of the air pipe 102 is inclined upwardly. A specially made connection element or adapter 103 for providing an appropriate flushing inlet for reverse circulation has to be connected to the bottom of the rotary head 5. Then, the reverse-circulation drilling tool 101 must be connected to the adapter 103 ensuring that the flushing inlet 35 is aligned with the air pipe 102. The rotary head 5 is then actuated to rotate the drilling tool 101 to drill downwardly and, at the same time, compressed air is pumped in through the flushing inlet 35 during drilling, drilling debris such as sea sand, mud and sediment and the like is pushed out with flow of river or sea water from the flushing outlet 11**.

Figure 9:
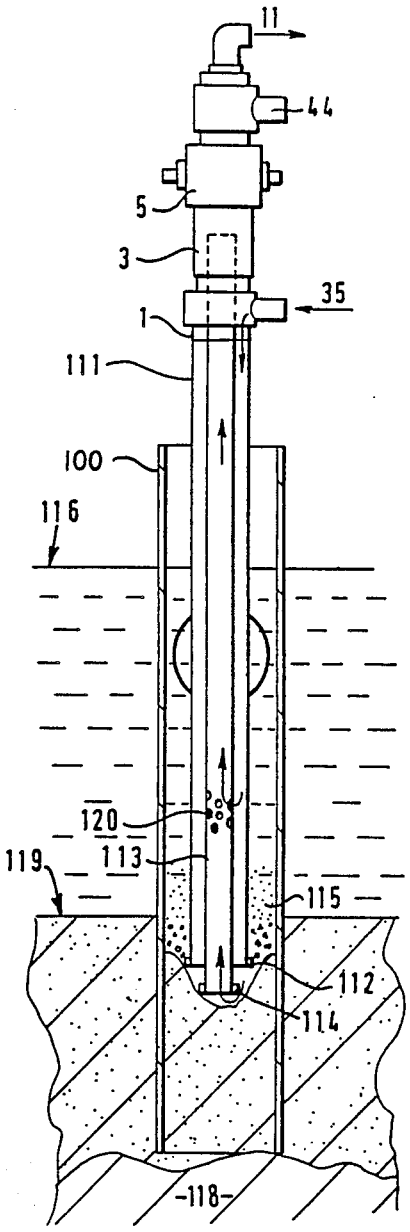
FIG. 9 illustrates a method of reverse-circulation drilling using a rotary head in accordance with the present invention.

FIG. 9 shows a method of circulation drilling in a sea or river bed using a rotary head in accordance with the invention.

As shown in FIG. 9, a 12 inch (30 cm) drilling casing 111 carrying a ring bit 112 is connected to the first connection device 1. A 7 inch (18 cm) drill pipe or casing 113 also carrying a ring bit 114 is then inserted into the 12 inch (30 cm) casing 111 and is clamped into position by the hydraulic clamp unit 3. Approximately 5 feet (150 cm) above the ring bit 114 approximately ten holes 120 of one inch (2.54 cm) in diameter are provided. Next, the hole or aperture 44 is blocked off and the hydraulic motor or motors 8 are actuated to rotate the drilling casings 111 and 113 to drill downwardly into, for example the sea bed 119, simultaneously. At the same time, compressed air is supplied via the flushing aperture 35 so that, during drilling, mud, clay and sand 115 inside the bottom of the pile tube 100 follow the flow of water-air mixture and are forced out through the flushing aperture 11.

Figure 10:
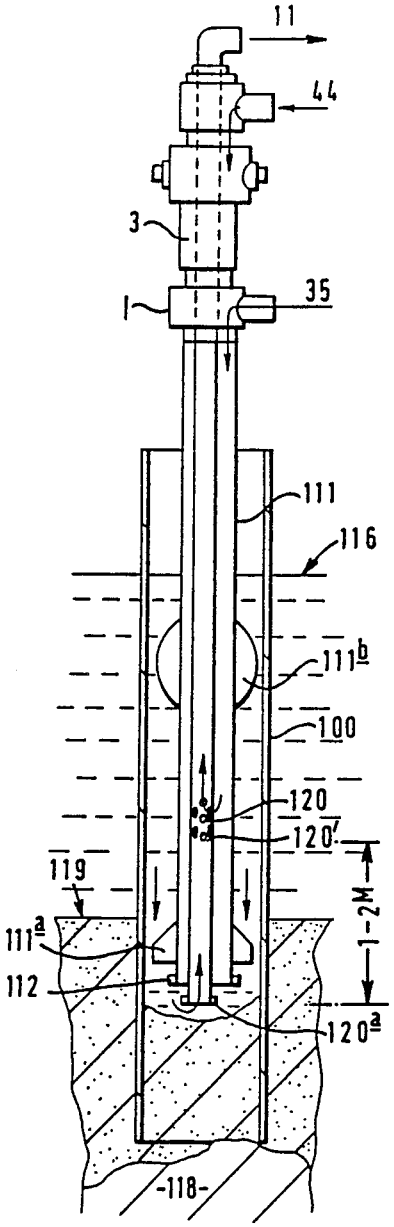
FIG. 10 illustrates a further method of reverse-circulation drilling using a rotary head in accordance with the present invention.

FIG. 10 illustrates a further new method of reverse-circulation drilling on the sea bed in which, as indicated the arrangement shown in FIG. 9, a 12 inch casing (30 cm) 111 is first connected to the connection element 1 assuming that the drilling machine carrying the rotary head has been appropriately positioned over the previously inserted pile tube 100. The 12 inch casing 111 carries a ring bit 112 and may also carry a big bold blade bit 111*a* outside of the ring bit. A central bit 111*b* may also be carried by the casing 111. A five inch (13 cm) diameter casing 120 carrying a five inch (13 cm) ring bit 120*a* is then inserted inside the 12 inch casing 111. As shown in FIG. 10, approximately ten holes 120' of one inch (2.5 cm) diameter are provided approximately 1 to 2 meters above the ring bit 120*a*. The flushing aperture 35 is then blocked or closed and the rotary head 5 is rotated using the hydraulic motor(s) 8 to drill downwardly into the sea bed. At the same time, compressed air is fed to the drilling tools via the flushing aperture 44 and, during drilling, clay, mud and sand inside the pile tube follow the water-air mixture and are forced from the flushing aperture 11.

Figure 11:
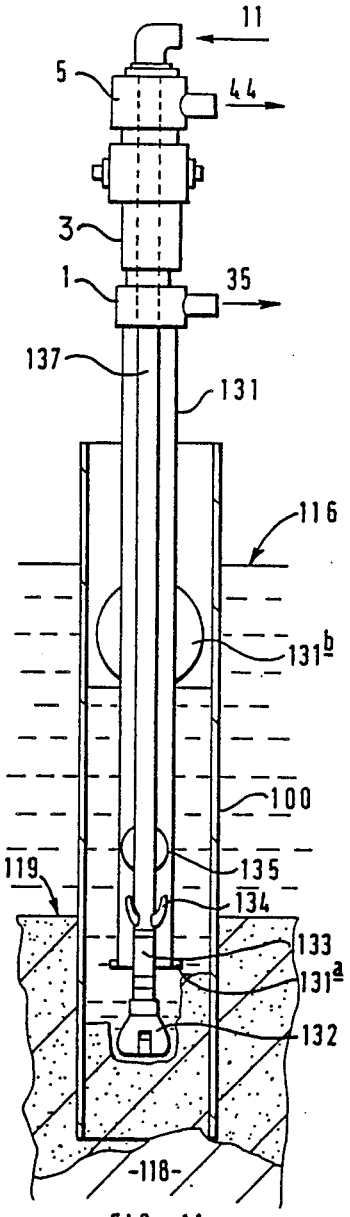
FIG. 11 llustrates a method of circulation drilling using a rotary head in accordance with the present invention.

FIG. 11 illustrates a new central circulation flushing method in which a 12 inch (30 cm) diameter drill casing 131 carrying a ring bit 131*a* and possibly a central drilling bit 131*b* is connected to the first connection device 1 and a three inch (7.6 cm) diameter drill rod 137 is inserted into the casing 131 to be engaged by the hydraulic clamp 3 and/or the second connection device at the top of the rotary head. The drill rod 137 carries a full-cone roller bit 133, the top of which is blocked off and is fitted with an upwardly extending 1 inch (2.5 cm) internal diameter pipe nozzle 134. A central drilling bit 135 is also fitted on the drilling rod 137. Next, the flushing aperture 44 is blocked or closed. The rotary head 5 is then rotated to cause the two sets of drill tools to drill down simultaneously. At the same time compressed air is supplied via the top flushing aperture inlet so that, during drilling, sea sand, marine clay, etc. are forced out through the flushing aperture 35 with the flow of air and sea water.

FIG. 12 illustrates another central circulation drilling method in which compressed air is supplied via the top aperture 11. In the method illustrated by FIG. 12, the bottom joint or connection device 1 and the flushing unit containing the flushing aperture 44 are removed from the rotary head 5 and a 7 inch (18 cm) diameter casing 140 carrying a ring bit 140*a* is dropped into a pile tube 141 previously inserted at the spot where drilling is desired. Next a three inch (7.6 cm) diameter drill rod 142 carrying a three cone rod bit 143 is inserted into the seven inch diameter casing and the top of the bit 143 is blocked so that no compressed air passes therethrough. A one or two piece VP jet pipe is fitted onto the three cone roller bit 143. Next, the three inch (7.6 cm) drill rod 142 is connected to an appropriate section of the three-stage flange adapter 62 and the 7 inch (18 cm) diameter casing 140 is clamped by the hydraulic clamp 3. The rotary head 5 is then rotated to cause the two sets of drill tools to drill down simultaneously into the sea bed. At the same time compressed air is supplied via the top flushing aperture 11 and sand and mud inside the pile tube 141 follow the flow of water and air indicated by the arrows and are forced out through the flushing aperture 44.

Although the results obtained by the methods illustrated by FIGS. 9, 10 and 12 are very good, the method illustrated in FIG. 11 provides the best results in practice.

FIG. 13 illustrates a new method of horizontal reverse-circulation drilling using a rotary head in accordance with the invention.

As shown in FIG. 13, respective 12 inch (30 cm) diameter, 7 inch (18 cm) diameter and 5 inch (13 cm) right hand thread drilling tools 146, 145 and 144 are connected to the rotary head, the drilling tool 144 being connected to the single section adapter 61, the drilling tool 145 being clamped by the hydraulic clamp unit 3 and the largest diameter drilling tool 146 engaging the connection device 1. Flushing water is then supplied through the flushing aperture 35 and/or the flushing aperture 44 into the drilling tools and the rotary head 5 is actuated to cause the drilling tools to drill forwardly into the surface in which the bore is required. During the drilling, sand and mud are forced by the flushing water out through the flushing aperture 11. As the bore being drilled gets deeper and deeper, the 12 inch (30 cm) casing 146 may be disconnected from the rotary head and used to support the bore. The 5 inch 13(13 cm) and 7 inch (1 cm) drilling tools 144 and 145 can then be used continuously to drill forward, the 7 inch (18 cm) inch drilling tool 145 being a casing which forms a shield to protect the 5 inch (13 cm) drilling tool 144 to prevent the drilled hole from bending or collapsing.

FIG. 14 illustrates a new method of drilling in a rocky or stony area of the sea or river bed. In this method, a 12 inch (30 cm) drilling case 147 carrying a ring bit 147*a* is connected to the connection device 1 and a 5½ inch (14 cm) diameter size drilling rod 148 is connected to the adapter 161 or 162, the end of the drilling rod carrying a 6½ inch (16.5 cm) diameter hole hammer 149. Compressed air is supplied via the flushing aperture 11. Initially, the hammer 149 is pulled up to make sure that the compressed air is passing through to the bit 147*a*. Next the hammer 149 is lowered so that the bit 147*a* touches the bottom of the bore and the rotary head is rotated to drill downwardly with two sets of drilling tools, namely the hammer and the drilling bit. Sand, mud and clay are forced out through the lower flushing aperture 35 and the intermediate flushing aperture 44 by the compressed air. When the drilling bit reaches the rocky area, the speed of rotation of the drilling tools is decreased by using the speed change lever 6. At the same time, the volume and pressure of the compressed air supply is increased so as to facilitate removal of the rock. The drilling tool should frequently be pulled up to make sure that the drilling is occurring easily. If difficulty occurs in drilling the 12 inch (30 cm) diameter casing 147 should be disconnected and left in the hole and the hammer 149 alone used. When drilling becomes easier again, the 12 inch (30 cm) diameter casing 147 may be reconnected and the two sets of drilling tools used again. When the 12 inch diameter (30 cm) casing 147 touches the bed rock, then the drilling is completed.

The method illustrated by FIG. 14 is particularly ideal because of the low costs involved and the fact that it is suitable for production of either big or small bores. The ODEX method now used in some countries is more expensive and only small drilling tools are available for use in such a method.

FIGS. 15 and 16 illustrated method of over-burden drilling using the rotary head in accordance with the invention. In the arrangements shown in FIGS. 15 and 16, two sets of drilling tools comprising an outer casing 150 carrying a ring bit 151 and an inner drill rod 152 carrying a, for example, hammer 153 are engaged with the rotary head in the manner similar to that described for the arrangement shown in FIG. 14. The two sets of drilling tools are then used to drill to a complicated or difficult area of ground, flushing fluid being supplied to the drilling tools via the flushing inlet 11 and being supplied from the drilling tools via the flushing outlets 44 and 35. When an easier or a steady area is reached, then the outer drilling tool or casing 150 may be disengaged and left in the hole and drilling continued with the inner tool only, the connection device and the flushing unit 2 having been removed as indicated in FIG. 16.

FIG. 17 illustrates a new method of grouting using a rotary head in accordance with the present invention. In this method, the connection device 1 and flushing aperture carrying unit are removed and a 7 inch (18 cm) diameter casing 164 is clamped by the clamp unit 3 to the rotary head. The adapter 61 and 62 is also removed and a 1 inch (2.54 cm) diameter grouting pipe 161 is inserted through the rotary head and extends into the bore in which a cement anchor is required. Cement is then pumped into the grouting pipe 161 to the pipe outlet 162 thereof and the bore is filled to a depth of approximately 20 feet (600 cm) to form an adequate anchor 163. The grouting pressure should be carefully observed during the grouting process and if the pressure increases to 200 psi ($1.38\times10^{6}Nm^{-2}$), the 7 inch (18 cm) diameter casing 164 should be pulled up using a back clamp of the rotary head 5 while the casing 164 is being rotated by the rotary head. As soon as the grouting pressure begins to decrease, pulling up of the 7 inch (18 cm) casing 164 can be stopped. The grouting should be stopped after 5 to 10 bags of cement have been poured into the hole. Then the grouting pipe 161 and the 7 inch (18 cm) diameter casing 164 should be removed one-by-one. from the bore.

The quality of the anchor made by this method is particularly good. In other countries, the grouting technique level is lower than in this method because of the lack of a rotary head in accordance with the present invention. Thus, for example, in Italy, a big bore drill head can only perform the grouting operation but cannot extract the casing simultaneously as the rotary head thereof has only one connection device.

As will be appreciated, in the rotary head described above, the second connection device 61 or 62 is provided at the top of the rotary head and the flushing aperture 11 thereof is provided inside the connection device 61 or 62, the hydraulic clamp 3 being provided beneath the connection device 61 or 62 so as to avoid the possibility of a rod being overscrewed or unscrewed from a connection device during, for example, overburden drilling, to prevent a drilling rod or other tool from dropping into the bore. Further, a lower or bottom connection device 1 is located beneath the hydraulic clamp so that up to three sets of drilling tools can be used simultaneously. Also, the rotary head is provided with a hydraulic motor drive which has a two-speed gear box allowing a rotation speed of 200 rpm using a single hydraulic motor and up to 400 rpm when two hydraulic motors are connected in series to enable full use to be made of the advantageous features of roller bits or diamond bits and therefore to increase efficiency. Furthermore the rotary head can be used in normal flushing or circulation flushing drilling operations and there is no need to use specially made tools when changing the direction of flushing. Also, the problems of drilling tools becoming detached and falling into a bore can be prevented or at least mitigated even with two or more drilling tools operating simultaneously.

It is readily apparent that the above-described rotary head meets all of the objects mentioned above and also has the advantage of wide commercial utility. It should be understood that the specific form of the invention hereinabove described is intended to be representative only, as certain modification within the scope of these teachings will be apparent to those skilled in the art.

Accordingly, reference should be made to the following claims in determining the full scope of the invention.

What is claimed is:

1. A rotary head for a drilling machine, said rotary head comprising:

means for engaging a plurality of drilling means, said engaging means including upper, intermediate and lower engaging means spaced apart on said rotary head for each engaging one or more drilling means, said upper engaging means including at least one adapter for connecting said drilling means to said rotary head, each adapter being provided with an aperture for supplying flushing liquid to or from said drilling means engaged by said engaging means, said at least one adapter includes a plurality of adapter sections, said adapter sections being of different cross-sectional areas so that said cross-sectional area of said adapter decreases in a stepwise manner, each adapter section having a surface formed with a screw-thread for engaging a screw-threaded end of said drilling means, wherein at least three adapter sections are provided and said screw-thread of at least two adjacent adapter sections extend in opposite directions;

means for rotating said drilling means engaged by said engaging means at a speed which is adjustable; and flushing means including a plurality of flushing inlet apertures for supplying flushing fluid to or from said drilling means engaged by said engaging means, said flushing means including three flushing apertures flushing fluid to or from drilling tools engaged by said engaging means.

2. A rotary head according to claim 1, wherein the adapter has a single screw-threaded adapter section.

3. A rotary head according to claim 1, wherein each adapter section is elongate and a flushing channel extends axially therethrough.

4. A rotary head according to claim 1, wherein a flushing aperture is provided on the rotary head adjacent the adapter.

5. A rotary head according to claim 1, wherein the lower engaging means comprises a connection device for engaging a drilling tool, the connection device being provided at an end of the rotary head which in use is lowermost.

6. A rotary head according to claim 1, wherein the lower engaging means comprises a connection device provided at an end of the rotary head opposite an end having the upper engaging means, the connection device being arranged to engage a drill casing for surrounding a drill rod or casing engaged by the adapter.

7. A rotary head according to claim 5, wherein a flushing outlet or inlet extends laterally of the connection device.

8. A rotary head according to claim 6, wherein a flushing outlet or inlet extends laterally of the connection device.

9. A rotary head according to claim 1, wherein the intermediate engaging means comprises gripping means for gripping a drilling tool means by the engaging means.

10. A rotary head according to claim 9, wherein the gripping means comprises a plurality of gripping jaws movable into and out of engagement with a drilling tool and hydraulic means for controllably moving the jaws.

11. A rotary head according to claim 10, wherein the jaws are arranged to rotate with a drilling tool engaged thereby.

12. A rotary head according to claim 1, wherein the rotating means comprises a gear arrangement for transmitting rotation from a single motor or motors.

13. A rotary head according to claim 12, wherein the gear arrangement comprises first and second gears fixedly mounted to a main shaft carrying the intermediate engaging means for rotating the main shaft, and third and fourth movable gears movable between a first position in which power is transmitted to the main shaft via the first and third gears and a second position in which power is transmitted via the second and fourth gears to the main shaft.

14. A rotary head for a drilling machine, the rotary head having an adapter for connecting a drilling tool to the rotary head, "said rotary head being generally cylindrical in shape," the adapter "removably mounted to the top of the rotary head and having an aperture therethrough for supplying" flushing fluid to a drilling tool connected thereto and the adapter comprising at least three adapter sections, the adapter sections being of different cross-sectional area so that the cross-sectional area of the adapter decreases in a step-wise manner, each adapter section having a surface formed with a screw-thread for engaging a screw-threaded end of a drilling tool, said screw-thread of at least two adjacent adapter sections extending in opposite directions.

15. A rotary head for a drilling machine, said rotary head comprising:

means for engaging a plurality of drilling means, said engaging means including upper, intermediate and lower engaging means spaced apart on said rotary head for each engaging one or more drilling means, said upper engaging means including at least one adapter for connecting said drilling means to said rotary head, each adapter being provided with an aperture for supplying flushing liquid to or from said drilling means engaged by said engaging means, said intermediate engaging means comprising gripping means for gripping said drilling means by said engaging means, said gripping means comprising a plurality of gripping jaws movable into and out of engagement with said drilling means and hydraulic means for controllably moving said gripping jaws;

means for rotating said drilling means engaged by said engaging means at a speed which is adjustable; and flushing means including a plurality of flushing inlet apertures for supplying flushing fluid to or from said drilling means engaged by said engaging means, said flushing means including three flushing apertures flushing fluid to or from drilling tools engaged by said engaging means.

* * * * *